US010727020B1

(12) United States Patent
Tseng et al.

(10) Patent No.: US 10,727,020 B1
(45) Date of Patent: Jul. 28, 2020

(54) SWITCH MODULE

(71) Applicant: Cheng Uei Precision Industry Co., Ltd., New Taipei (TW)

(72) Inventors: Chi Ming Tseng, New Taipei (TW); Wen Hsiang Tai, New Taipei (TW)

(73) Assignee: Cheng Uei Precision Industry Co., Ltd., New Taipei (TW)

( * ) Notice: Subject to any disclaimer, the term of this patent is extended or adjusted under 35 U.S.C. 154(b) by 0 days.

(21) Appl. No.: 16/659,667

(22) Filed: Oct. 22, 2019

(30) Foreign Application Priority Data

Jul. 22, 2019 (CN) ..... 2019 2 1154957 U

(51) Int. Cl.

| | |
|---|---|
| ***H01H 89/00*** | (2006.01) |
| ***H01H 15/00*** | (2006.01) |
| ***H01H 15/24*** | (2006.01) |
| ***H01H 15/10*** | (2006.01) |

(52) U.S. Cl.
CPC ..... *H01H 89/00* (2013.01); *H01H 15/005* (2013.01); *H01H 15/10* (2013.01); *H01H 15/24* (2013.01); *H01H 2221/014* (2013.01); *H01H 2225/01* (2013.01); *H01H 2225/018* (2013.01); *H01H 2225/03* (2013.01)

(58) Field of Classification Search
CPC ..... H01H 89/00; H01H 15/10; H01H 15/24; H01H 15/005
USPC ..... 200/42.01
See application file for complete search history.

(56) References Cited

U.S. PATENT DOCUMENTS 8,416,040 B2 * 4/2013 Terao ..... G05G 1/08 335/114
2019/0329127 A1 * 10/2019 Chou ..... A63F 13/22

* cited by examiner

*Primary Examiner* — Nguyen Tran
*Assistant Examiner* — Iman Malakooti
(74) *Attorney, Agent, or Firm* — Lin & Associates Intellectual Property, Inc.

(57) ABSTRACT

A switch module includes an outer shell, a button and a bracket. The button is disposed to the outer shell. The button has a base board. One side of a bottom surface of the base board is recessed in the upward direction to form an avoiding groove. A rear of the bottom surface of the base board protrudes in the downward direction to form a driving pillar. The bracket is disposed under the button. A top surface of the bracket is recessed in the downward direction to form an accommodating groove. A top surface of a bottom wall of the accommodating groove is defined as a stopping surface. The driving pillar projects beyond the stopping surface. A front end of the top surface of the bottom wall of the accommodating groove is recessed downward to form an avoiding plane.

11 Claims, 11 Drawing Sheets

SWITCH MODULE

CROSS-REFERENCE TO RELATED APPLICATION

The present application is based on, and claims priority from, China Patent Application No. 201921154957.6, filed Jul. 22, 2019, the disclosure of which is hereby incorporated by reference herein in its entirety.

BACKGROUND OF THE INVENTION

1. Field of the Invention

The present invention generally relates to a switch, and more particularly to a switch module having a lower cost and saving a space.

2. The Related Art

A wireless mouse has a wireless transmission capability. The wireless mouse is matched with a host computer to be used via a wireless technology. When a user operates the wireless mouse, the wireless mouse will be without being limited by a cable, so the wireless mouse is used conveniently.

Generally, the host computer has a USB (Universal Serial Bus) receptacle, and a USB adapter is inserted into the receptacle. A common wireless mouse need be connected with the USB adapter to transmit operation instructions of the common wireless mouse to the computer host. However, when the common wireless mouse is used, the USB adapter need be provided for the user, and a volume of the USB adapter is quite small, a loss problem of the USB adapter will be caused in use.

Another common wireless mouse is a bluetooth mouse. The bluetooth mouse can be paired with the host computer via a bluetooth technology to be used, and the USB adapter has no need of being provided in addition. Whereas, the bluetooth mouse need be provided with an extra pairing button, when the user uses the bluetooth mouse, a power switch of the bluetooth mouse need be turned on, and then the pairing button is pressed to proceed a bluetooth pairing.

However, the bluetooth mouses on the market, the power switch and the pairing button of each bluetooth mouse are mostly a two-piece separated structure, so a manufacturing cost of the bluetooth mouse is higher, and the bluetooth mouse need be considered to have a larger assembling space in design for assembling the power switch and the pairing button.

Thus, it is essential to provide an innovative switch module having a lower cost and saving space.

SUMMARY OF THE INVENTION

An object of the present invention is to provide a switch module. The switch module includes an outer shell, a button and a bracket. The outer shell opens an operating hole vertically penetrating through the outer shell. One end of the operating hole is defined as a first position, and the other end of the operating hole is defined as a second position. The button is disposed to a bottom surface of the outer shell. The button has a base board, and an operating column protruded in an upward direction from a top surface of the base board. One side of a bottom surface of the base board is recessed in the upward direction to form an avoiding groove. A front end of a bottom surface of the base board protrudes in a downward direction to form a first sliding rib. A rear of the bottom surface of the base board protrudes in the downward direction to form a driving pillar spaced a distance from the first sliding rib. The operating column passes through the operating hole. The operating column moves between the first position and the second position. The bracket is disposed under the button. A middle of a top surface of the bracket is recessed in the downward direction to form an accommodating groove. A rear end of a top surface of a bottom wall of the accommodating groove is defined as a stopping surface. A middle of the bottom wall of the accommodating groove opens an opening vertically penetrating through the bottom wall of the accommodating groove. The driving pillar and the stopping surface face to each other. The driving pillar of the button projects beyond the stopping surface and projects into the opening. A front end of the top surface of the bottom wall of the accommodating groove is recessed downward to form an avoiding plane located adjacent to and spaced from a front end of the stopping surface. The avoiding plane and the stopping surface have a height difference. When the operating column is located at the first position, the first sliding rib is located on and blocked by the stopping surface, when the operating column of the button is located at the second position, the first sliding rib moves to the avoiding plane.

Another object of the present invention is to provide a switch module. The switch module includes a button, a bracket and a circuit board. The button has a top surface and a bottom surface opposite to each other. The top surface of the button has an operating column. The operating column moves between a first position and a second position, and the bottom surface of the button has a first sliding rib. The bottom surface of the button has a protruding block, and a driving pillar spaced a distance from the first sliding rib. The bracket is disposed corresponding to the bottom surface of the button. The bracket has a top surface and a bottom surface opposite to each other. The bracket has a stopping surface recessed in a downward direction. The bracket opens an opening penetrating through the top surface and the bottom surface of the bracket. The driving pillar passes through the opening. One end of the bracket is recessed downward to form an avoiding plane. The avoiding plane and the stopping surface are shown as a step shape. The driving pillar and the stopping surface face to each other. The circuit board is disposed corresponding to the bottom surface of the bracket. The top surface of the circuit board is equipped with a first switch and a second switch. When the operating column is located at the first position, the protruding block is without contacting the first switch, the driving pillar is without contacting the second switch, the first sliding rib is located on and blocked by the stopping surface, when the operating column is located at the second position, the first sliding rib moves to and is corresponding to the avoiding plane, the protruding block contacts and triggers the first switch, the driving pillar is corresponding to and contacts the second switch.

Another object of the present invention is to provide a switch module. The switch module includes an outer shell, a button, a bracket and a circuit board. The outer shell opens an operating hole vertically penetrating through the outer shell. One end of the operating hole is defined as a first position, and the other end of the operating hole is defined as a second position. The button is disposed to a bottom surface of the outer shell. The button has a base board, and an operating column protruded in an upward direction from a top surface of the base board. One side of a bottom surface of the base board is recessed in the upward direction to form an avoiding groove. A rear of a top wall of the avoiding groove protrudes in a downward direction to form a protruding block. A front end of a bottom surface of the base board protrudes in the downward direction to form a first sliding rib. A rear of the bottom surface of the base board protrudes in the downward direction to form a driving pillar spaced a distance from the first sliding rib. The operating column moves between the first position and the second position. The bracket is disposed under the button. A middle of a top surface of the bracket is recessed in the downward direction to form an accommodating groove. A rear end of a top surface of a bottom wall of the accommodating groove is defined as a stopping surface. A middle of the bottom wall of the accommodating groove opens an opening vertically penetrating through the bottom wall of the accommodating groove. The driving pillar and the stopping surface face to each other. The driving pillar of the button projects beyond the stopping surface and projects into the opening. A front end of the top surface of the bottom wall of the accommodating groove is recessed downward to form an avoiding plane located adjacent to and spaced from a front end of the stopping surface. The avoiding plane and the stopping surface have a height difference. The circuit board is fastened under the bracket. A top surface of the circuit board is equipped with a first switch and a second switch. When the operating column is located at the first position, the first sliding rib is located on and blocked by the stopping surface, the protruding block is without contacting the first switch, the driving pillar is without contacting the second switch, when the operating column of the button is located at the second position, the first sliding rib moves to the avoiding plane, the protruding block contacts the first switch, the driving pillar contacts the second switch.

As described above, when the operating column of the button is stirred leftward and rightward, the button slides in a space formed between the receiving groove of the outer shell and the accommodating groove of the bracket, when the operating column of the button is located at the first position, the protruding block of the button is without contacting with the first switch, a buckling pillar of the bracket is received in a first buckling groove of the button, the first sliding rib is blocked by the stopping surface, at the moment, the switch module is in a power-off status and the button is incapable of being pressed downward, when the operating column of the button is located at the second position, the protruding block of the button contacts with the first switch after the protruding block of the button moves towards a frontward direction, the buckling pillar of the bracket is received in a second buckling groove of the button, the first sliding rib moves towards the frontward direction to the avoiding plane, at the moment, the switch module is in a power-on status and the button is capable of being pressed downward to execute a bluetooth pairing function, and a cantilever arm of the bracket is an elastomer, and an elastic deformation of the button, the elastic deformation of the cantilever arm of the bracket makes the button have a sectioned feeling at the time of the button moving along the frontward direction or a second direction, the user easily recognizes an operating status. Thus the switch module has a lower manufacturing cost and saves an assembling space.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
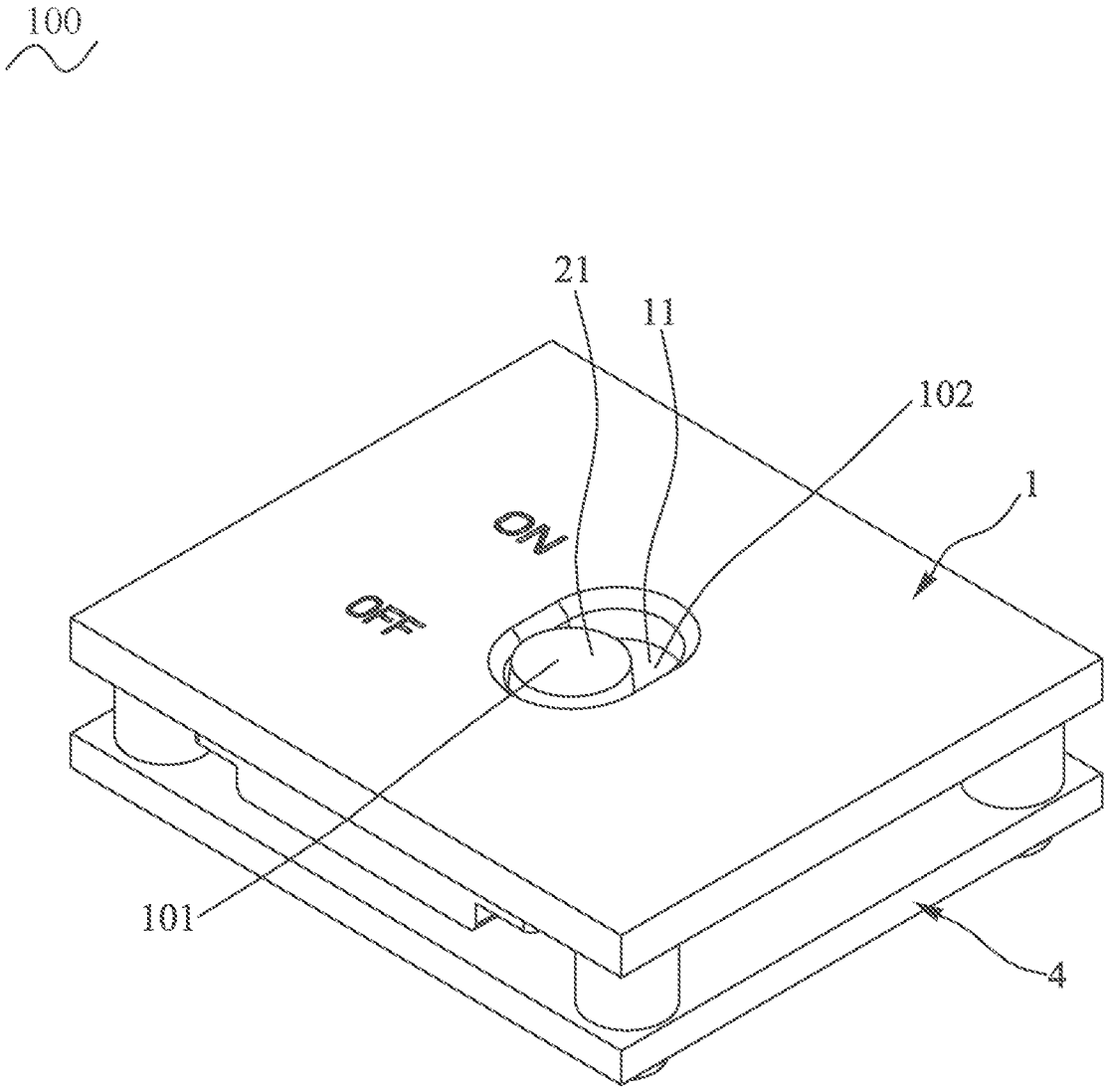
FIG. 1 is a perspective view of a switch module in accordance with a preferred embodiment of the present invention.

With reference to FIG. 1 to FIG. 5, a switch module 100 in accordance with a preferred embodiment of the present invention is shown. The switch module 100 is adapted for being assembled to a bluetooth mouse. The switch module 100 includes an outer shell 1, a button 2, a bracket 3, a circuit board 4 and a plurality of fastening elements 5. Each fastening element 5 is a nut. In the preferred embodiment, the switch module 100 is one of other wireless devices. A frontward direction is defined as a first direction 8. A rearward direction is defined as a second direction 9 opposite to the first direction 8. A top surface and a bottom surface of each of the outer shell 1, the button 2, the bracket 3, the circuit board 4 and the plurality of fastening elements 5 are defined as a first surface 103 and a second surface 104 opposite to each other, respectively.

Figure 2:
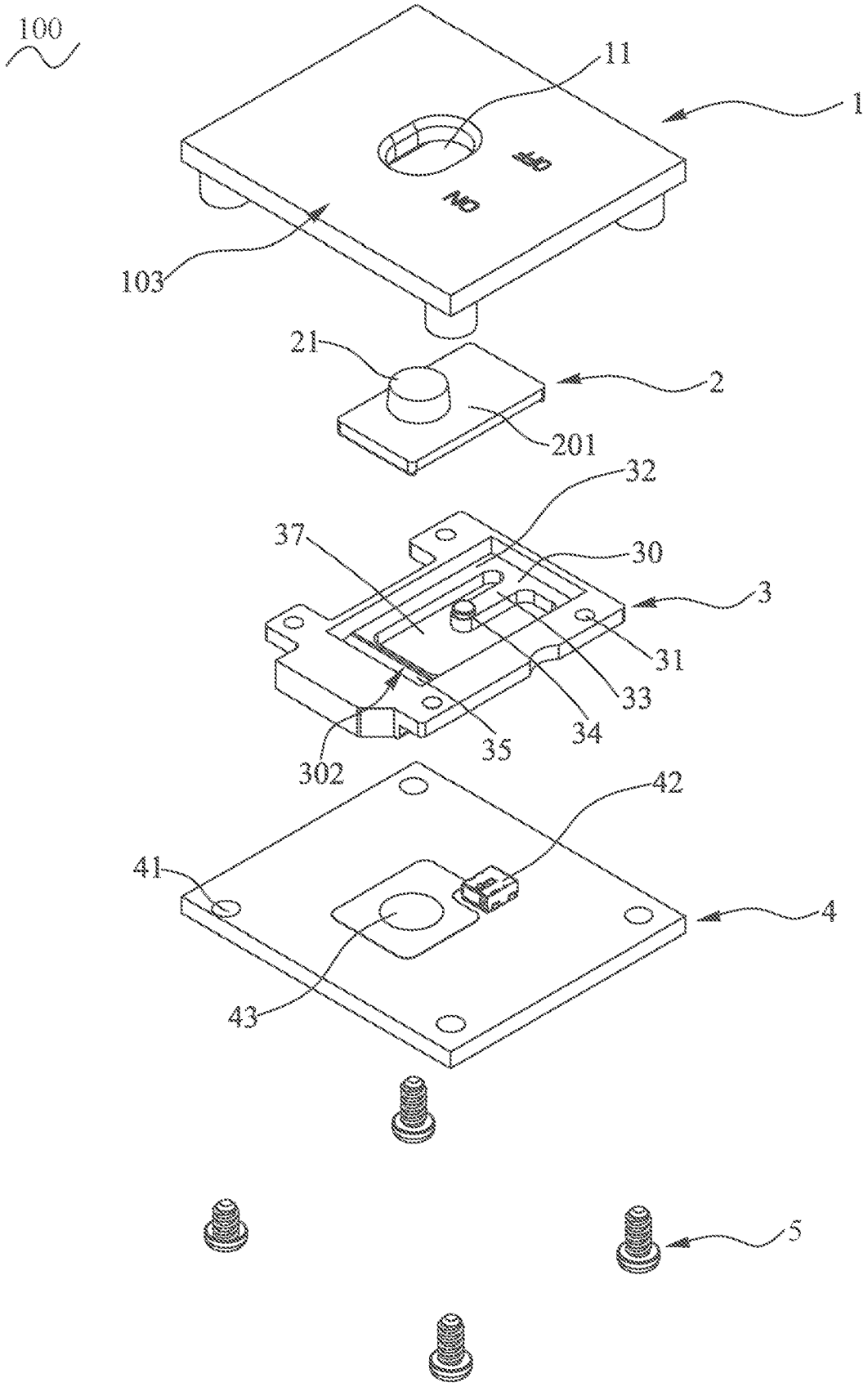
FIG. 2 is an exploded view of the switch module of FIG. 1.
Figure 3:
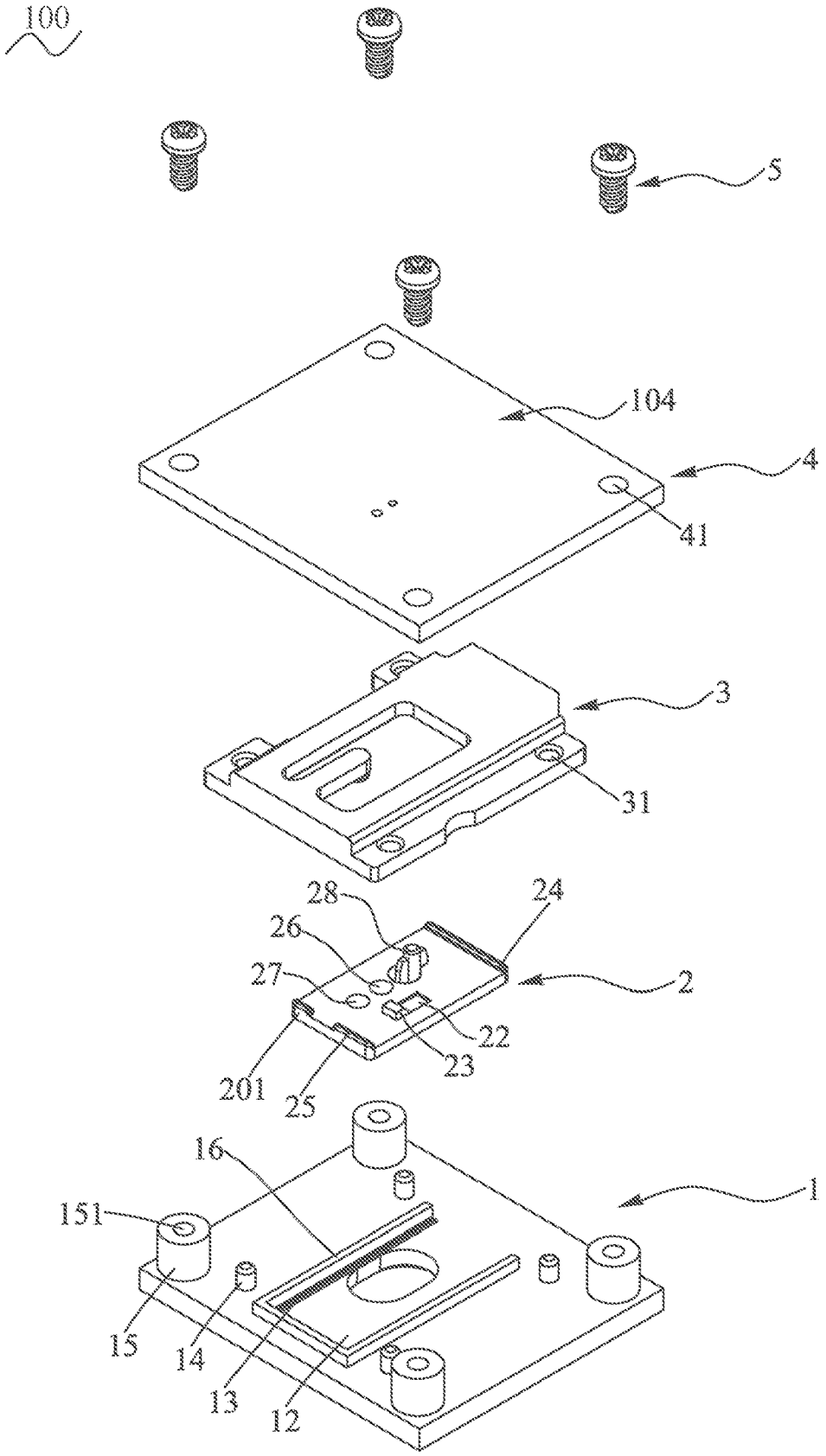
FIG. 3 is another exploded view of the switch module of FIG. 1.
Figure 4:
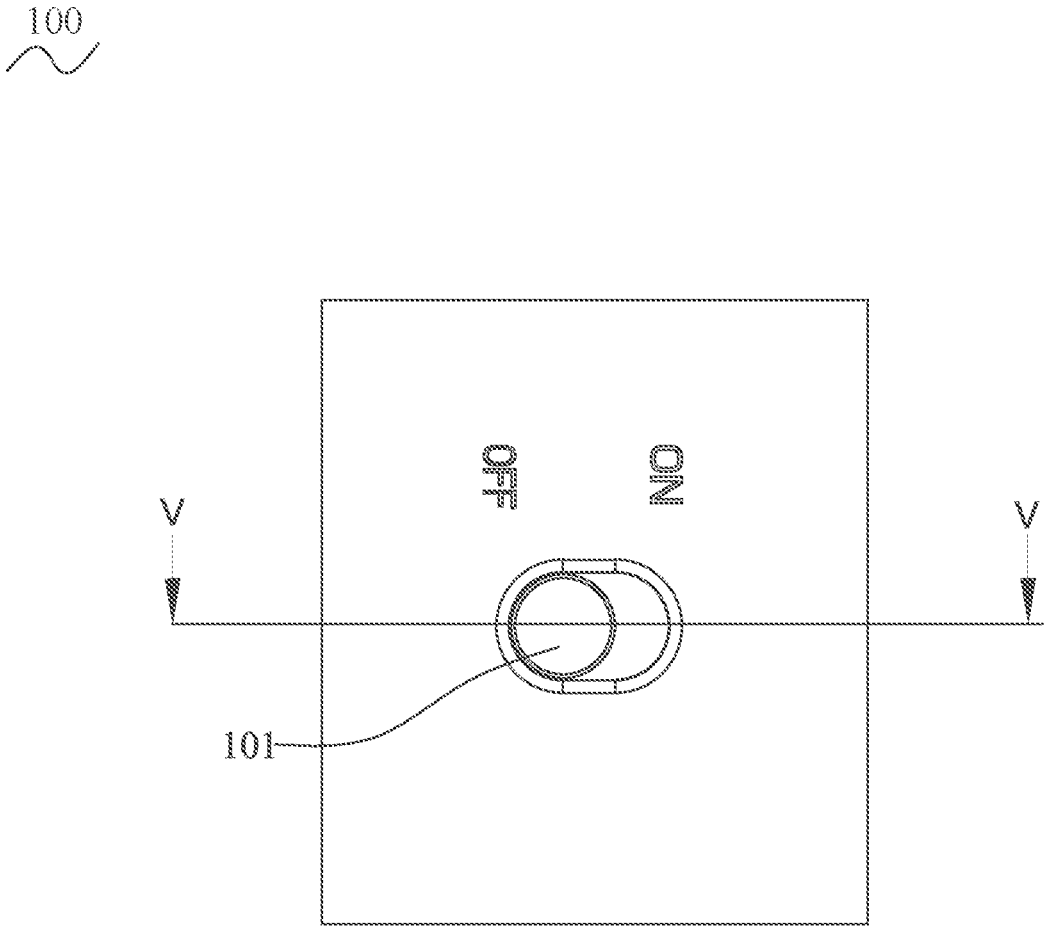
FIG. 4 is a schematic diagram of the switch module of FIG. 1, wherein a button of the switch module is shown as an off status.
Figure 5:
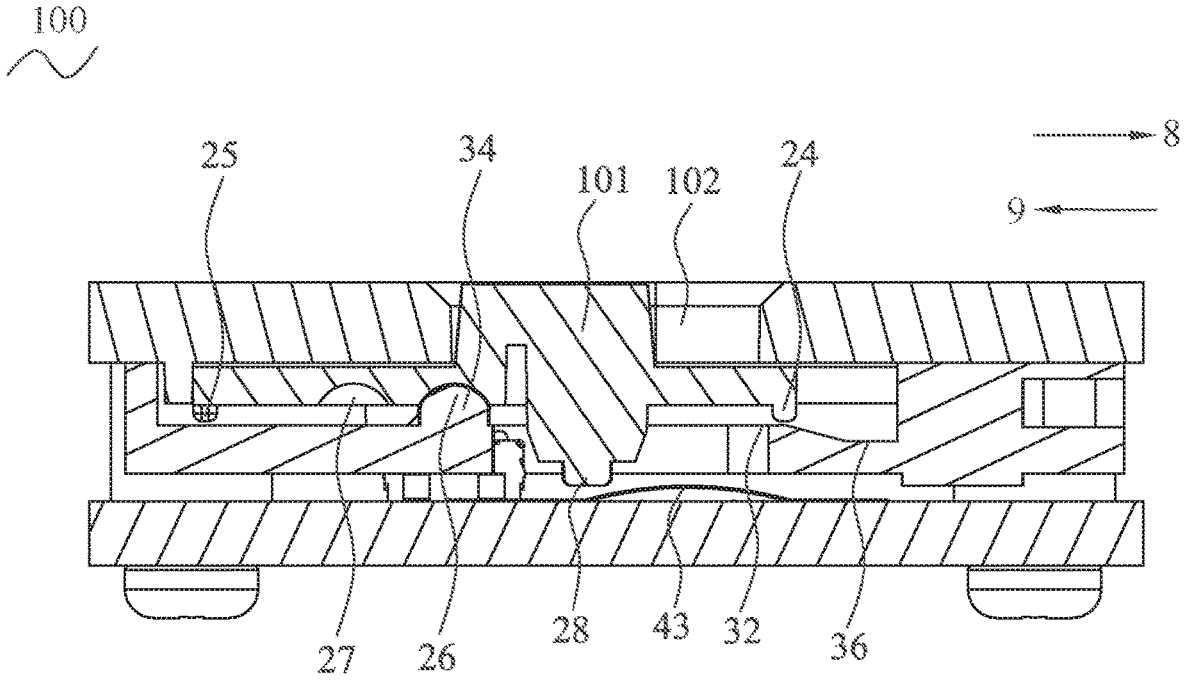
FIG. 5 is a sectional perspective view of the switch module along a line V-V of FIG. 4.
Figure 6:
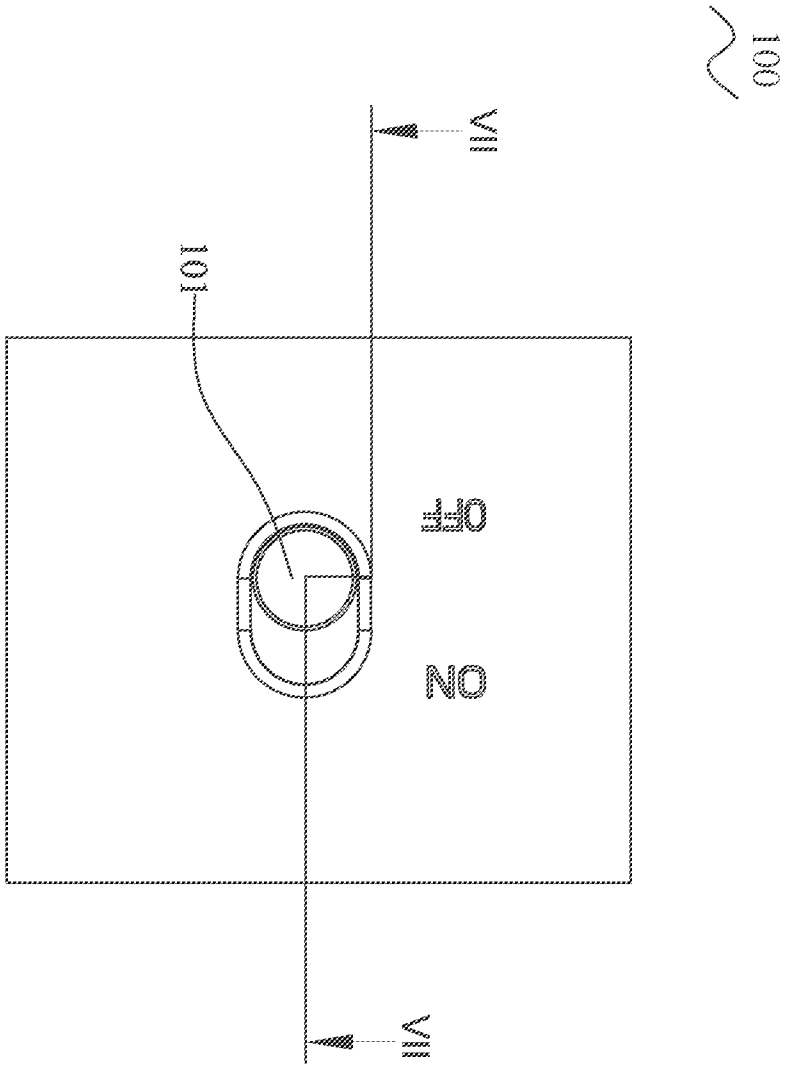
FIG. 6 is another schematic diagram of the switch module of FIG. 1, wherein the button of the switch module is shown as the off status.
Figure 7:
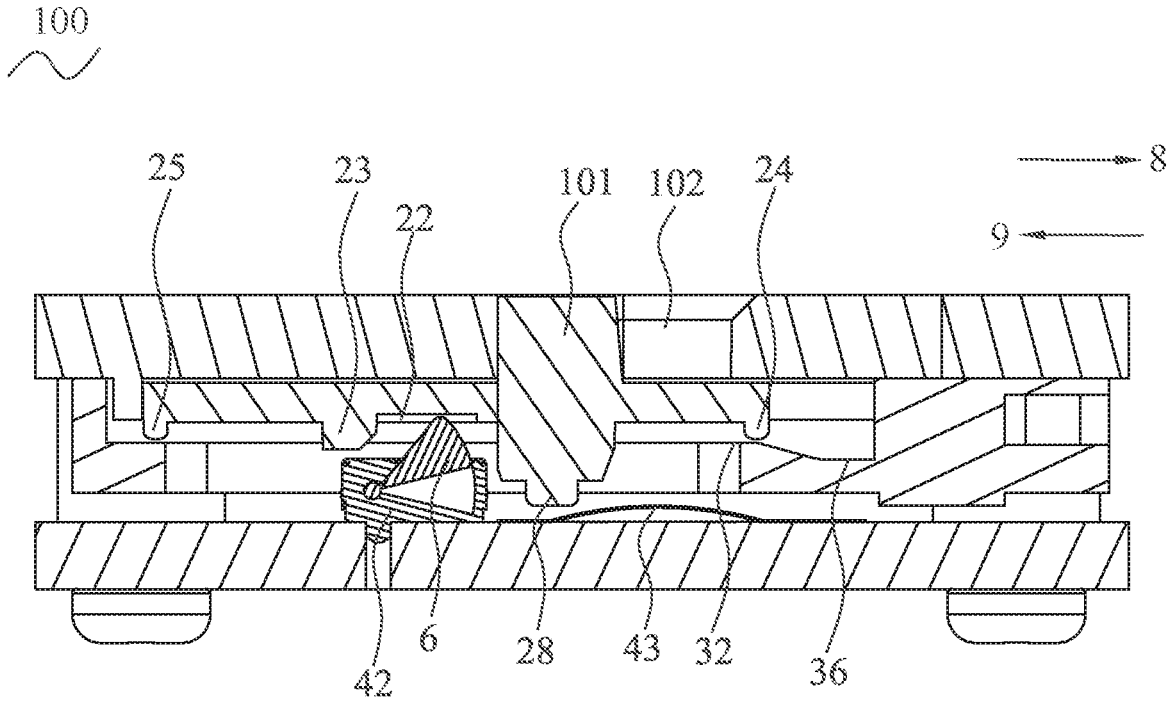
FIG. 7 is a sectional perspective view of the switch module along a line VII-VII of FIG. 6.
Figure 8:
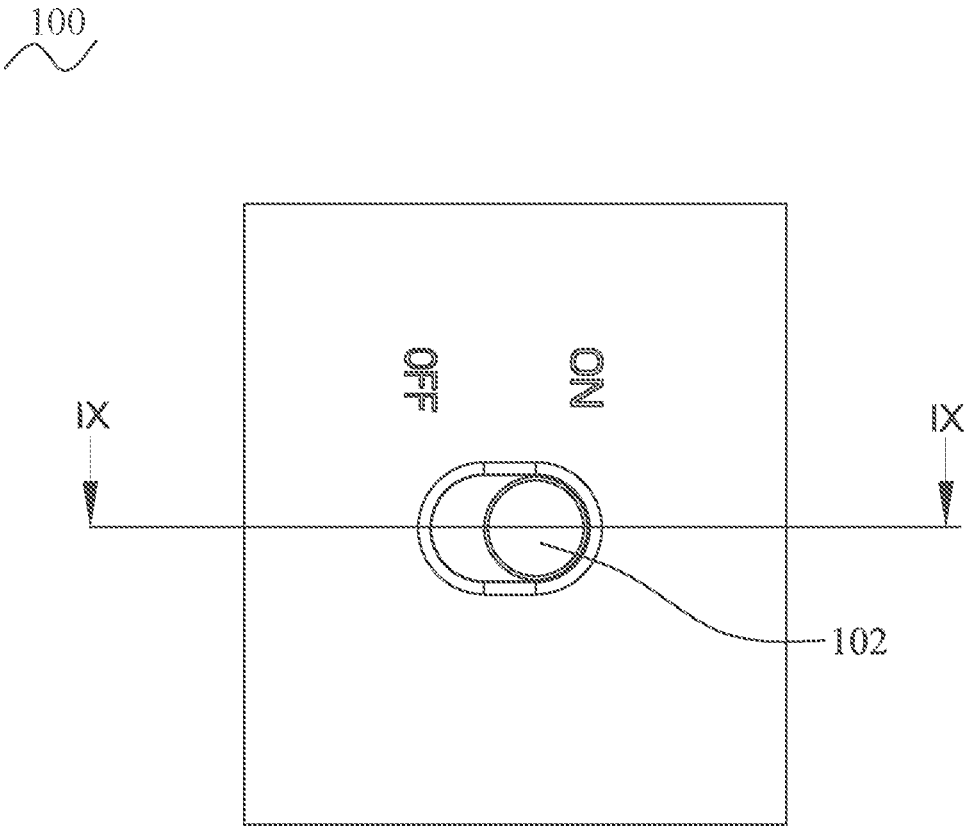
FIG. 8 is a schematic diagram of the switch module of FIG. 1, wherein the button of the switch module is shown as an on status.
Figure 9:
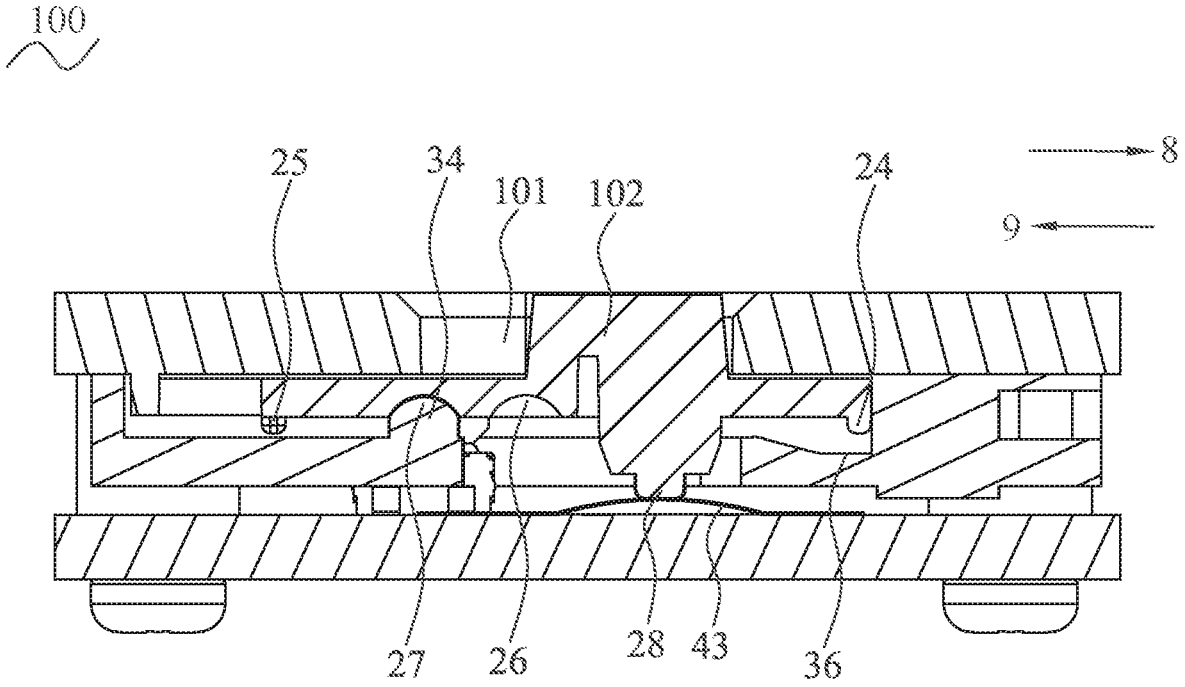
FIG. 9 is a sectional perspective view of the switch module along a line IX-IX of FIG. 8.
Figure 10:
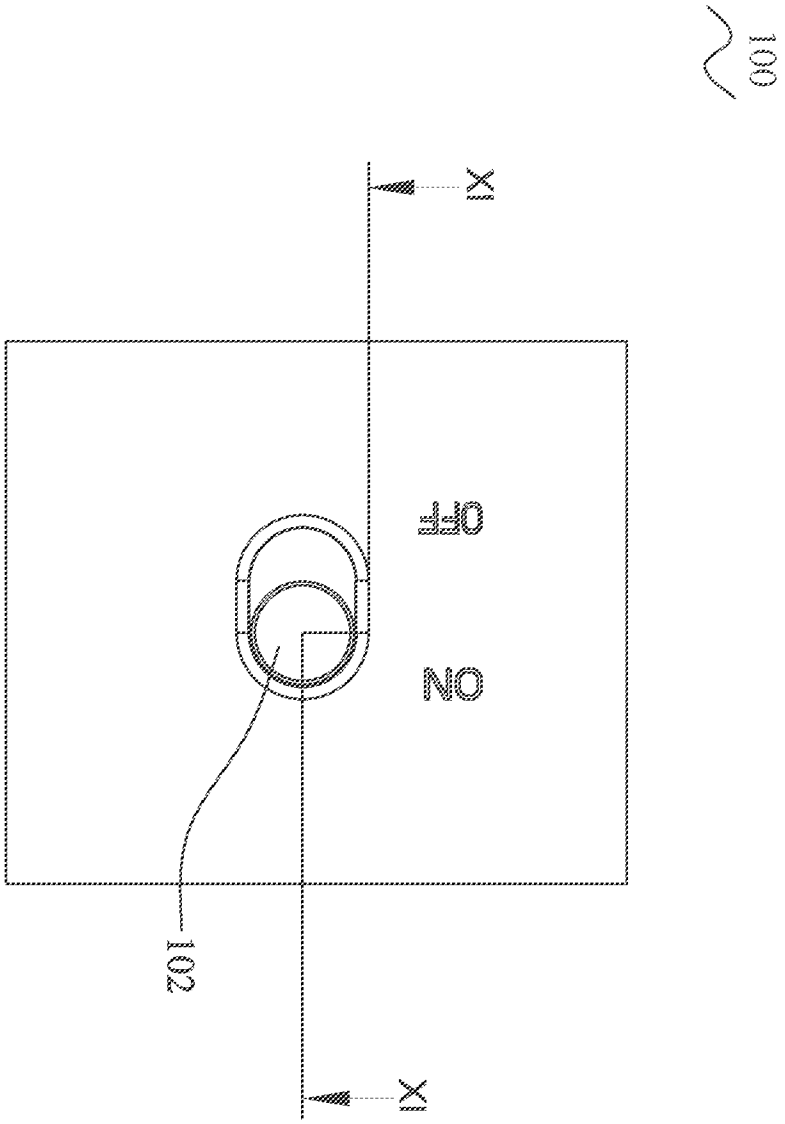
FIG. 10 is a schematic diagram of the switch module of FIG. 1, wherein the button of the switch module is shown as an on status.
Figure 11:
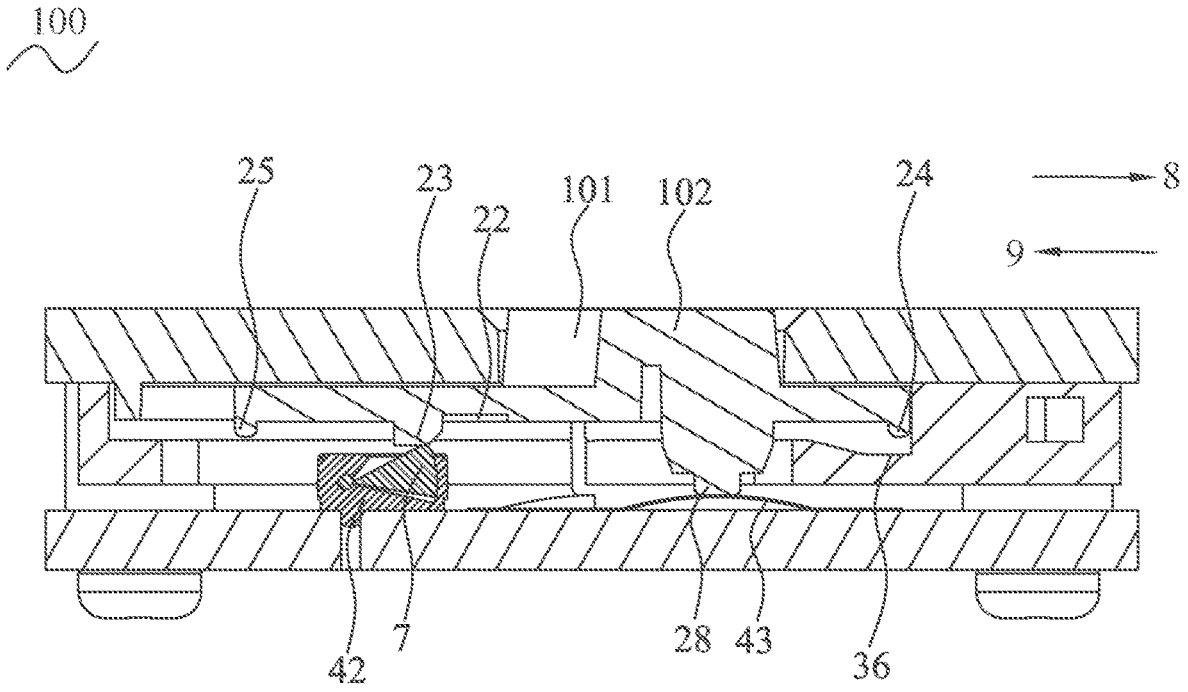
FIG. 11 a sectional perspective view of the switch module along a line XI-XI of FIG. 10.

Referring to FIG. 1 to FIG. 3, the button 2 is disposed to the bottom surface of the outer shell 1. The first surface 103 of the button 2 is covered by the outer shell 1. The outer shell 1 has the first surface 103 and the second surface 104 opposite to each other, respectively. The bracket 3 is disposed under the button 2. The button 2 is received in the bracket 3. The bracket 3 is fastened to and located to the outer shell 1. The circuit board 4 is fastened under the bracket 3. The plurality of the fastening elements 5 are used for fastening the circuit board 4 and the outer shell 1.

A middle of the outer shell 1 opens an operating hole 11 vertically penetrating through the first surface 103 and the second surface 104 of the outer shell 1. One end of the operating hole 11 is defined as a first position 101, and the other end of the operating hole 11 is defined as a second position 102. The second surface 104 which is the bottom surface of the outer shell 1 protrudes in a downward direction to form a U-shaped limiting rib 16. A bottom surface of a peripheral wall of the operating hole 11 protrudes in the downward direction to form the U-shaped limiting rib 16. The mouth of the limiting rib 16 faces towards the frontward direction. A middle of the limiting rib 16 has a receiving groove 12. Several portions of the bottom surface of the outer shell 1 protrude in the downward direction to form a plurality of the locating pillars 14 and a plurality of fastening pillars 15. Several portions of the bottom surface of the peripheral wall of the operating hole 11 protrude in the downward direction to form the plurality of locating pillars 14 disposed around the limiting rib 16. The outer shell 1 further has the plurality of fastening pillars 15 protruded in the downward direction from the bottom surface of the peripheral wall of the operating hole 11. The limiting rib 16 and the plurality of the locating pillars 14 are disposed among the plurality of the fastening pillars 15. The operating hole 11 is a perforation. The limiting rib 16 is disposed around the operating hole 11. The button 2 is disposed in the receiving groove 12 of the limiting rib 16. Corresponding mechanisms of the button 2 execute sliding and pressing actions in the operating hole 11 for realizing switch-on and switch-off actions of the switch module 100. In the preferred embodiment, the outer shell 1 has four locating pillars 14 and four fastening pillars 15. A middle of each fastening pillar 15 has a screw hole 151.

The button 2 is received in the receiving groove 12 for realizing a location and a fixation between the outer shell 1 and the button 2. In the preferred embodiment, inner sides of two side walls of the receiving groove 12 protrude face to face to form two sliding blocks 13. The button 2 is guided by the two sliding blocks 13. The two sliding blocks 13 are used for supporting two sides of the button 2. The plurality of the locating pillars 14 is used for fastening the bracket 3 to realize a location and a fixation between the outer shell 1 and the bracket 3. Each fastening element 5 is fastened in the screw hole 151 of one fastening pillar 15 for realizing a location and a fixation between the outer shell 1 and the circuit board 4. In the preferred embodiment, each locating pillar 14 is located adjacent to and spaced from an inner side of one fastening pillar 15. The receiving groove 12 is located in an inside of the limiting rib 16.

Referring to FIG. 1 to FIG. 11, the button 2 and the limiting rib 16 are accommodated in the accommodating groove 30 of the bracket 3. The button 2 has a base board 201, and an operating column 21 protruded in an upward direction from a top surface of the base board 201. A middle of one side of a bottom surface of the base board 201 is recessed in the upward direction to form an avoiding groove 22 extending longitudinally. A rear of a top wall of the avoiding groove 22 protrudes in the downward direction to form a protruding block 23. The protruding block 23 is connected with the top wall of the avoiding groove 22. A front end of the bottom surface of the base board 201 protrudes in the downward direction to form a first sliding rib 24. A rear end of the bottom surface of the base board 201 protrudes in the downward direction to form a second sliding rib 25. Two portions of the bottom surface of the base board 201 are recessed in the upward direction to form a first buckling groove 26, and a second buckling groove 27 located in front of the first buckling groove 26. A rear of the bottom surface of the base board 201 protrudes in the downward direction to form a driving pillar 28. The operating column 21 is disposed in the operating hole 11. The operating column 21 passes through the operating hole 11 of the outer shell 1. The button 2 is placed in the receiving groove 12 for realizing the location and the fixation between the outer shell 1 and the button 2. The operating column 21 of the button 2 moves between the first position 101 and the second position 102. The button 2 has the top surface and the bottom surface opposite to each other. The top surface of the button 2 has the operating column 21, and the bottom surface of the button 2 has the first sliding rib 24. The bottom surface of the button 2 has the protruding block 23 and the driving pillar 28 spaced a distance from the first sliding rib 24.

The avoiding groove 22 is formed in the bottom surface of the button 2. The avoiding groove 22 is used for preventing a corresponding mechanism of the circuit board 4 from contacting with the button 2. A rear end of the avoiding groove 22 is equipped with the protruding block 23 for pressing the corresponding mechanism of the circuit board 4 to make the switch module 100 execute a circuit switch sensing. The protruding block 23 presses or breaks away from the corresponding mechanism of the circuit board 4 to make the switch module 100 switch between a power-off status 6 and a power-on status 7. The first buckling groove 26, the second buckling groove 27 and the driving pillar 28 are disposed in alignment. The first buckling groove 26 and the second buckling groove 27 are used for buckling a buckling pillar 34 of the bracket 3 for realizing a location and a fixation between the button 2 and the bracket 3. When the operating column 21 is pressed in the downward direction, after the driving pillar 28 bears a pressing force, the driving pillar 28 contacts with the corresponding mechanism of the circuit board 4 for executing a press sensing, the switch module 100 further realizes a bluetooth pairing function.

The bracket 3 is disposed corresponding to the bottom surface of the button 2. The bracket 3 has the top surface and the bottom surface opposite to each other. The bracket 3 opens an opening 37 penetrating through the top surface and the bottom surface of the bracket 3. A middle of the top surface of the bracket 3 is recessed in the downward direction to form an accommodating groove 30. The bracket 3 opens a plurality of location holes 31 vertically penetrating through the bracket 3. The plurality of the locating pillars 14 of the outer shell 1 are located in the location holes 31 for realizing the location and the fixation between the outer shell 1 and the bracket 3. A rear end of a top surface of a bottom wall of the accommodating groove 30 is defined as a stopping surface 32. The bracket 3 has the stopping surface 32 recessed in the downward direction. The driving pillar 28 and the stopping surface 32 face to each other. The protruding block 23 faces to the stopping surface 32. A middle of the bottom wall of the accommodating groove 30 opens the opening 37 vertically penetrating through the bottom wall of the accommodating groove 30. A middle of a front surface of a rear wall of the opening 37 extends in the frontward direction to form a cantilever arm 33 projecting into the opening 37. A top surface of a free end of the cantilever arm 33 protrudes in the upward direction to form the buckling pillar 34 projecting into the accommodating groove 30.

One end of the bracket 3 is recessed downward to form an avoiding plane 36. A front end of the top surface of the bottom wall of the accommodating groove 30 is recessed downward to form the avoiding plane 36 located adjacent to and spaced from a front end of the stopping surface 32. The bracket 3 further has an avoiding slope 35 slantwise extended in the frontward direction and the downward direction from the front end of the stopping surface 32. The avoiding plane 36 extends in the first direction to form the avoiding slope 35. The avoiding plane 36 is located in front of the avoiding slope 35. When the button 2 moves along the frontward direction or the second direction 9, the buckling pillar 34 is switched to different positions between the first buckling groove 26 and the second buckling groove 27. The avoiding plane 36 and the stopping surface 32 have a height difference. The avoiding plane 36 is lower than the stopping surface 32. The avoiding plane 36 and the stopping surface 32 are shown as a step shape.

In the preferred embodiment, the cantilever arm 33 of the bracket 3 is an elastomer. An elastic deformation of the cantilever arm 33 of the bracket 3 makes the button 2 have a sectioned feeling at the time of the button 2 moving along the frontward direction or the second direction 9, a user easily recognizes an operating status. The driving pillar 28 of the button 2 is received in the accommodating groove 30. The driving pillar 28 of the button 2 projects beyond the stopping surface 32 and projects into the opening 37. The driving pillar 28 passes through the opening 37.

The circuit board 4 is disposed corresponding to the bottom surface of the bracket 3. The circuit board 4 opens a plurality of through-holes 41 distributed around a periphery of the circuit board 4. A middle of the top surface of the circuit board 4 is equipped with a first switch 42, and a second switch 43 adjacent to the first switch 42. In the preferred embodiment, the first switch 42 is a power switch. The second switch 43 is a pairing switch. After the plurality of the through-holes 41 are corresponding to the plurality of the fastening pillars 15 of the outer shell 1, the plurality of the fastening elements 5 pass through the plurality of the through-holes 41 and are embedded in the plurality of the fastening pillars 15. The plurality of the fastening elements 5 are embedded in the screw holes 151 of the plurality of the fastening pillars 15 for fastening the switch module 100. In the preferred embodiment, another fastening way is used for fastening the switch module 100. The first switch 42 of the circuit board 4 is used for contacting with or breaking away from the protruding block 23 of the button 2 so as to realize that the switch module 100 is switched between the power-off status 6 and the power-on status 7. The first switch 42 of the circuit board 4 contacts with or breaks away from the protruding block 23 of the button 2 to make the switch module 100 switched between the power-off status 6 and the power-on status 7. The second switch 43 is used for contacting with the driving pillar 28 to execute a bluetooth pairing function at the time of the driving pillar 28 being pressed in the downward direction.

Referring to FIG. 2 to FIG. 7, when the operating column 21 of the button 2 is located at the first position 101, the protruding block 23 of the button 2 is without contacting the first switch 42, the driving pillar 28 is without contacting the second switch 43, at the moment, the switch module 100 is shown as the power-off status 6. The first sliding rib 24 is located on and blocked by the stopping surface 32 to make the button 2 have no way of being pressed. When the button 2 is located at the first position 101, and the first sliding rib 24 is located on and blocked by the stopping surface 32, the protruding block 23 is without contacting the first switch 42, the buckling pillar 34 of the bracket 3 is fastened in the first buckling groove 26 of the button 2. In the preferred embodiment, when the button 2 is located at the first position 101, the switch module 100 is in the power-off status 6 and the button 2 is incapable of being pressed in the downward direction.

Referring to FIG. 2 to FIG. 11, when the operating column 21 of the button 2 is located at the second position 102, after the protruding block 23 of the button 2 moves towards the frontward direction, the first sliding rib 24 moves along the frontward direction to and is corresponding to the avoiding plane 36, the protruding block 23 of the button 2 contacts and triggers the first switch 42 of the circuit board 4, the driving pillar 28 is corresponding to and contacts the second switch 43, at the moment, the switch module 100 is in the power-on status 7. When the first sliding rib 24 moves along the frontward direction to the avoiding plane 36, the protruding block 23 contacts the first switch 42, the button 2 is capable of being pressed in the downward direction, so that after the driving pillar 28 bears a downward pressing force, the driving pillar 28 contacts with the second switch 43 of the circuit board 4 for executing the bluetooth pairing function. When the button 2 is located at the second position 102, the buckling pillar 34 of the bracket 3 is fastened in the second buckling groove 27 of the button 2. In the preferred embodiment, when the operating column 21 of the button 2 is located at the second position 102, the switch module 100 is in the power-on status 7 and the button 2 is capable of being pressed downward to execute the bluetooth pairing function.

When the operating column 21 of the button 2 is stirred leftward and rightward, the button 2 slides in a space 302 formed between the receiving groove 12 of the outer shell 1 and the accommodating groove 30 of the bracket 3. When the operating column 21 of the button 2 is located at the first position 101, the protruding block 23 of the button 2 is without contacting with the first switch 42, the buckling pillar 34 of the bracket 3 is received in the first buckling groove 26 of the button 2. The first sliding rib 24 is blocked by the stopping surface 32, at the moment, the switch module 100 is in the power-off status 6 and the button 2 is incapable of being pressed downward. When the operating column 21 of the button 2 is located at the second position 102, the protruding block 23 of the button 2 contacts with the first switch 42 after the protruding block 23 of the button 2 moves towards the frontward direction, the buckling pillar 34 of the bracket 3 is received in the second buckling groove 27 of the button 2, the first sliding rib 24 moves towards the frontward direction to the avoiding plane 36, at the moment, the switch module 100 is in the power-on status 7 and the button 2 is capable of being pressed downward to execute the bluetooth pairing function, and the cantilever arm 33 of the bracket 3 is the elastomer, and the elastic deformation of the button 2, the elastic deformation of the cantilever arm 33 of the bracket 3 makes the button 2 have the sectioned feeling at the time of the button 2 moving along the frontward direction or the second direction 9, the user easily recognizes the operating status. Thus a manufacturing cost and an assembling space of the switch module 100 is lowered.

As described above, when the operating column 21 of the button 2 is stirred leftward and rightward, the button 2 slides in the space 302 formed between the receiving groove 12 of the outer shell 1 and the accommodating groove 30 of the bracket 3, when the operating column 21 of the button 2 is located at the first position 101, the protruding block 23 of the button 2 is without contacting with the first switch 42, the buckling pillar 34 of the bracket 3 is received in the first buckling groove 26 of the button 2, the first sliding rib 24 is blocked by the stopping surface 32, at the moment, the switch module 100 is in the power-off status 6 and the button 2 is incapable of being pressed downward, when the operating column 21 of the button 2 is located at the second position 102, the protruding block 23 of the button 2 contacts with the first switch 42 after the protruding block 23 of the button 2 moves towards the frontward direction, the buckling pillar 34 of the bracket 3 is received in the second buckling groove 27 of the button 2, the first sliding rib 24 moves towards the frontward direction to the avoiding plane 36, at the moment, the switch module 100 is in the power-on status 7 and the button 2 is capable of being pressed downward to execute the bluetooth pairing function, and the cantilever arm 33 of the bracket 3 is the elastomer, and the elastic deformation of the button 2, the elastic deformation of the cantilever arm 33 of the bracket 3 makes the button 2 have the sectioned feeling at the time of the button 2 moving along the frontward direction or the second direction 9, the user easily recognizes the operating status. Thus the switch module 100 has the lower manufacturing cost and saves the assembling space.

What is claimed is:

1. A switch module, comprising:

an outer shell opening an operating hole vertically penetrating through the outer shell, one end of the operating hole being defined as a first position, and the other end of the operating hole being defined as a second position;

a button disposed to a bottom surface of the outer shell, the button having a base board, and an operating column protruded in an upward direction from a top surface of the base board, one side of a bottom surface of the base board being recessed in the upward direction to form an avoiding groove, a front end of a bottom surface of the base board protruding in a downward direction to form a first sliding rib, a rear of the bottom surface of the base board protruding in the downward direction to form a driving pillar spaced a distance from the first sliding rib, the operating column passing through the operating hole, the operating column moving between the first position and the second position; and a bracket disposed under the button, a middle of a top surface of the bracket being recessed in the downward direction to form an accommodating groove, a rear end of a top surface of a bottom wall of the accommodating groove being defined as a stopping surface, a middle of the bottom wall of the accommodating groove opening an opening vertically penetrating through the bottom wall of the accommodating groove, the driving pillar and the stopping surface facing to each other, the driving pillar of the button projecting beyond the stopping surface and projecting into the opening, a front end of the top surface of the bottom wall of the accommodating groove being recessed downward to form an avoiding plane located adjacent to and spaced from a front end of the stopping surface, the avoiding plane and the stopping surface having a height difference, wherein when the operating column is located at the first position, the first sliding rib is located on and blocked by the stopping surface, when the operating column of the button is located at the second position, the first sliding rib moves to the avoiding plane.

2. The switch module as claimed in claim 1, further comprising a circuit board, a middle of a top surface of the circuit board being equipped with a first switch, a rear of a top wall of the avoiding groove protruding in the downward direction to form a protruding block, the first switch contacting with or breaking away from the protruding block to make the switch module switched between a power-off status and a power-on status.

3. The switch module as claimed in claim 2, wherein a front surface of a rear wall of the opening extends in a frontward direction to form a cantilever arm projecting into the opening, a top surface of a free end of the cantilever arm protrudes in the upward direction to form a buckling pillar, two portions of the bottom surface of the base board are recessed in the upward direction to form a first buckling groove, and a second buckling groove located in front of the first buckling groove, when the button is located at the first position, the buckling pillar is fastened in the first buckling groove, when the button is located at the second position, the buckling pillar is fastened in the second buckling groove.

4. The switch module as claimed in claim 2, wherein the protruding block faces to the stopping surface.

5. A switch module, comprising:

a button having a top surface and a bottom surface opposite to each other, the top surface of the button having an operating column, the operating column moving between a first position and a second position, and the bottom surface of the button having a first sliding rib, the bottom surface of the button having a protruding block, and a driving pillar spaced a distance from the first sliding rib;

a bracket disposed corresponding to the bottom surface of the button, the bracket having a top surface and a bottom surface opposite to each other, the bracket having a stopping surface recessed in a downward direction, the bracket opening an opening penetrating through the top surface and the bottom surface of the bracket, the driving pillar passing through the opening, one end of the bracket being recessed downward to form an avoiding plane, the avoiding plane and the stopping surface being shown as a step shape, the driving pillar and the stopping surface facing to each other; and a circuit board disposed corresponding to the bottom surface of the bracket, the top surface of the circuit board being equipped with a first switch and a second switch, wherein when the operating column is located at the first position, the protruding block is without contacting the first switch, the driving pillar is without contacting the second switch, the first sliding rib is located on and blocked by the stopping surface, when the operating column is located at the second position, the first sliding rib moves to and is corresponding to the avoiding plane, the protruding block contacts and triggers the first switch, the driving pillar is corresponding to and contacts the second switch.

6. The switch module as claimed in claim 5, wherein the protruding block faces to the stopping surface, the button has a base board, one side of a bottom surface of the base board is recessed in an upward direction to form an avoiding groove extending longitudinally, a rear of a top wall of the avoiding groove protrudes in a downward direction to form a protruding block, the protruding block is connected with the top wall of the avoiding groove.

7. The switch module as claimed in claim 5, further comprising an outer shell opening an operating hole vertically penetrating through the outer shell, one end of the operating hole being defined as the first position, and the other end of the operating hole being defined as the second position, the operating column passing through the operating hole, the operating column moving between the first position and the second position.

8. The switch module as claimed in claim 7, wherein a top surface and a bottom surface of each of the outer shell, the button, the bracket and the circuit board are defined as a first surface and a second surface opposite to each other, respectively.

9. The switch module as claimed in claim 8, wherein the first surface of the button is covered by the outer shell, the outer shell has the first surface and the second surface opposite to each other, respectively, the outer shell opens an operating hole vertically penetrating through the first surface and the second surface of the outer shell, the operating column is disposed in the operating hole, the second surface of the outer shell protrudes in the downward direction to form a U-shaped limiting rib, a middle of the limiting rib has a receiving groove, the button is disposed in the receiving groove of the limiting rib, the button and the limiting rib are accommodated in the accommodating groove of the bracket, inner sides of two side walls of the receiving groove protrude face to face to form two sliding blocks, the button is guided by the two sliding blocks.

10. The switch module as claimed in claim 5, wherein a middle of the top surface of the bracket is recessed in the downward direction to form an accommodating groove, a rear end of a top surface of a bottom wall of the accommodating groove is defined as the stopping surface, a front end of the top surface of the bottom wall of the accommodating groove is recessed downward to form the avoiding plane located adjacent to and spaced from a front end of the stopping surface, the bracket further has an avoiding slope slantwise extended in a frontward direction and the downward direction from the front end of the stopping surface, a middle of the bottom wall of the accommodating groove opens the opening vertically penetrating through the bottom wall of the accommodating groove, a middle of a front surface of a rear wall of the opening extends in the frontward direction to form a cantilever arm projecting into the opening, a top surface of a free end of the cantilever arm protrudes in an upward direction to form a buckling pillar projecting into the accommodating groove.

11. A switch module, comprising:

an outer shell opening an operating hole vertically penetrating through the outer shell, one end of the operating hole being defined as a first position, and the other end of the operating hole being defined as a second position;

a button disposed to a bottom surface of the outer shell, the button having a base board, and an operating column protruded in an upward direction from a top surface of the base board, one side of a bottom surface of the base board being recessed in the upward direction to form an avoiding groove, a rear of a top wall of the avoiding groove protruding in a downward direction to form a protruding block, a front end of a bottom surface of the base board protruding in the downward direction to form a first sliding rib, a rear of the bottom surface of the base board protruding in the downward direction to form a driving pillar spaced a distance from the first sliding rib, the operating column moving between the first position and the second position;

a bracket disposed under the button, a middle of a top surface of the bracket being recessed in the downward direction to form an accommodating groove, a rear end of a top surface of a bottom wall of the accommodating groove being defined as a stopping surface, a middle of the bottom wall of the accommodating groove opening an opening vertically penetrating through the bottom wall of the accommodating groove, the driving pillar and the stopping surface facing to each other, the driving pillar of the button projecting beyond the stopping surface and projecting into the opening, a front end of the top surface of the bottom wall of the accommodating groove being recessed downward to form an avoiding plane located adjacent to and spaced from a front end of the stopping surface, the avoiding plane and the stopping surface having a height difference; and a circuit board fastened under the bracket, a top surface of the circuit board being equipped with a first switch and a second switch, wherein when the operating column is located at the first position, the first sliding rib is located on and blocked by the stopping surface, the protruding block is without contacting the first switch, the driving pillar is without contacting the second switch, when the operating column of the button is located at the second position, the first sliding rib moves to the avoiding plane, the protruding block contacts the first switch, the driving pillar contacts the second switch.

* * * * *